US007607473B2

(12) United States Patent
Ichiyanagi

(10) Patent No.: US 7,607,473 B2
(45) Date of Patent: Oct. 27, 2009

(54) HEAT EXCHANGER

(75) Inventor: Shigeharu Ichiyanagi, Oyama (JP)

(73) Assignee: Showa Denko K.K., Tokyo (JP)

( * ) Notice: Subject to any disclaimer, the term of this patent is extended or adjusted under 35 U.S.C. 154(b) by 623 days.

(21) Appl. No.: 10/588,209

(22) PCT Filed: Apr. 11, 2005

(86) PCT No.: PCT/JP2005/007355

§ 371 (c)(1),
(2), (4) Date: Aug. 2, 2006

(87) PCT Pub. No.: WO2005/100900

PCT Pub. Date: Oct. 27, 2005

(65) Prior Publication Data

US 2007/0131391 A1 Jun. 14, 2007

Related U.S. Application Data

(60) Provisional application No. 60/562,532, filed on Apr. 16, 2004.

(30) Foreign Application Priority Data

Apr. 12, 2004 (JP) ..... 2004-116418
Feb. 25, 2005 (JP) ..... 2005-049946

(51) Int. Cl.
*F28F 9/02* (2006.01)
*F28D 1/02* (2006.01)

(52) U.S. Cl. ..... 165/173; 165/174

(58) Field of Classification Search ..... 165/173, 165/174, 175, 176, 153
See application file for complete search history.

(56) References Cited

U.S. PATENT DOCUMENTS 5,241,839 A * 9/1993 Hughes ..... 62/515
5,415,223 A * 5/1995 Reavis et al. ..... 165/96
5,934,367 A * 8/1999 Shimmura et al. ..... 165/174

(Continued)

FOREIGN PATENT DOCUMENTS

JP 63233297 A * 9/1988

(Continued)

OTHER PUBLICATIONS

U.S. Appl. No. 11/578,552, filed Oct. 16, 2006, Ichiyanagi.

(Continued)

*Primary Examiner*—Tho v Duong
(74) *Attorney, Agent, or Firm*—Oblon, Spivak, McClelland, Maier & Neustadt, L.L.P.

(57) ABSTRACT

An evaporator has a header tank including a header forming plate with outward bulging portions, a tube connecting plate, and an intermediate plate. Tube insertion holes are formed in the tube connecting plate. Communication holes formed in the intermediate plate cause the tube insertion holes to communicate with the interior of the corresponding outward bulging portion therethrough. At least one of the outward bulging portions allows a refrigerant to flow therethrough longitudinally. All the communication holes in communication with the refrigerant passing bulging portion are held in communication by communication portions for the communication holes, the communication portions providing a refrigerant passageway. The refrigerant passageway is altered in cross sectional area along the longitudinal direction thereof by adjusting the width of the communication portions.

11 Claims, 14 Drawing Sheets

U.S. PATENT DOCUMENTS

| | | | | |
|---|---|---|---|---|
| 6,827,139 | B2 * | 12/2004 | Kawakubo et al. | 165/173 |
| 2002/0134538 | A1 * | 9/2002 | Moreau | 165/173 |
| 2004/0159121 | A1 * | 8/2004 | Horiuchi et al. | 62/526 |

FOREIGN PATENT DOCUMENTS

| | | |
|---|---|---|
| JP | 2 62282 | 5/1990 |
| JP | 2001 133189 | 5/2001 |
| JP | 2003 519356 | 6/2003 |
| WO | 03 054467 | 7/2003 |

OTHER PUBLICATIONS

U.S. Appl. No. 11/564,038, filed Nov. 28,2006, Ichiyanagi, et al.
U.S. Appl. No. 11/566,311, filed Dec. 4, 2006, Ichiyanagi, et al.
U.S. Appl. No. 10/583,764, filed Jun. 21, 2006, Ichiyanagi.
U.S. Appl. No. 10/588,774, filed Aug. 8, 2006, Ichiyanagi, et al.

* cited by examiner

HEAT EXCHANGER

CROSS REFERENCE TO RELATED APPLICATION

This application is an application filed under 35 U.S.C. §111(a) claiming the benefit pursuant to 35 U.S.C. §119(e)(1) of the filing date of Provisional Application No. 60/562,532 filed Apr. 16, 2004 pursuant to 35 U.S.C. §111(b).

TECHNICAL FIELD

The present invention relates to heat exchangers, and more particularly to heat exchangers which are suitable to use as gas coolers or evaporators of supercritical refrigeration cycles wherein a supercritical refrigerant, such as $CO_2$ (carbon dioxide) refrigerant, is used.

The term "aluminum" as used herein and in the appended claims includes aluminum alloys in addition to pure aluminum.

BACKGROUND ART

Already known for use in supercritical refrigeration cycles is a heat exchanger comprising a pair of header tanks arranged as spaced apart from each other, heat exchange tubes arranged in parallel at a spacing between the pair of header tanks and having opposite ends joined to the respective header tanks, and fins arranged in respective air passing clearances between respective adjacent pairs of heat exchange tubes and each brazed to the tubes adjacent thereto, each of the header tanks comprising a header member in the form of a major arc in cross section, a pipe connecting plate having tube inserting slits extending through the thickness thereof and arranged longitudinally thereof at a spacing, the connecting plate being in the form of a minor arc in cross section for closing a longitudinal opening of the header member, an intermediate plate disposed inwardly of the tube connecting plate and extending therealong, the intermediate plate having a plurality of communication holes extending therethrough and arranged longitudinally thereof at a spacing for holding the respective tube inserting slits in communication with the interior of the header member therethrough, and caps closing respective opposite end openings (see the publication of JP-A No. 2001-133189, FIGS. 1 to 5).

However, the header tank included in the heat exchanger of the publication requires caps for closing opposite end openings and therefore has the problem of necessitating an increased number of components and being low in the efficiency of work for joining the caps to the header member, pipe connecting plate and intermediate plate. Additionally, the caps must be made as separate members and are cumbersome to make.

To improve the heat exchanger disclosed in the publication in heat exchange performance, it is desirable to change the course of flow of the refrigerant, for example, by dividing the interior of at least one of the header tanks with a partition, whereas this entails the problem that the provision of the partition requires a cumbersome procedure.

The heat exchanger disclosed in the publication further has the problem that all the heat exchange tubes joined to the header tanks are likely to become uneven in the rate of flow of the refrigerant therethrough, consequently exhibiting impaired heat exchange performance.

An object of the present invention is to overcome the above problems and to provide a heat exchanger which is smaller in the number of components, can be fabricated by more efficient work and higher in heat exchange performance than conventional heat exchanger headers.

DISCLOSURE OF THE INVENTION

To fulfill the above object, the present invention comprises the following modes.

1) A heat exchanger comprising a pair of header tanks arranged as spaced apart from each other, and a plurality of heat exchange tubes arranged in parallel between the pair of header tanks and each having opposite ends joined to the respective header tanks, each of the header tanks comprising a header forming plate, a tube connecting plate and an intermediate plate interposed between the two plates, the header forming plate, the tube connecting plate and intermediate plate being arranged in superposed layers and brazed to one another, the header forming plate being provided with at least one outward bulging portion extending longitudinally thereof and having an opening closed with the intermediate plate, the tube connecting plate being provided at a portion thereof corresponding to the outward bulging portion with a plurality of tube insertion holes arranged longitudinally of the tube connecting plate at a spacing and extending through the thickness thereof, the intermediate plate having communication holes extending through the thickness thereof for causing the respective tube insertion holes of the tube connecting plate to communicate with interior of the outward bulging portion of the header forming plate therethrough, the heat exchange tubes having their opposite ends inserted into the respective tube insertion holes of the tube connecting plates of the header tanks and brazed to the tube connecting plates, at least one of all the outward bulging portions serving as a refrigerant passing outward bulging portion for causing a refrigerant to flow through the interior thereof longitudinally thereof, the intermediate plate communication holes in communication with the refrigerant passing outward bulging portion being held in communication by communication portions formed in the intermediate plate, the communication portions and the communication holes thereby held in communication providing a refrigerant passageway for causing the refrigerant to flow therethrough longitudinally of the refrigerant passing outward bulging portion, the communication portions being adjusted in width to alter the cross sectional area of the refrigerant passageway along the lengthwise direction of the passageway.

2) A heat exchanger according to par. 1) wherein the header forming plate, the tube connecting plate and the intermediate plate are each made from a metal plate by press work.

3) A heat exchanger according to par. 1) wherein the cross sectional area of the refrigerant passageway formed in the intermediate plate decreases toward the downstream side with respect to the direction of flow of the refrigerant.

4) A heat exchanger according to par. 1) wherein the cross sectional area of the refrigerant passageway formed in the intermediate plate increases toward the downstream side with respect to the direction of flow of the refrigerant.

5) A heat exchanger according to par. 1) wherein the header forming plate of the first of the pair of header tanks has four outward bulging portions arranged widthwise thereof at a spacing and longitudinally thereof at a spacing, and the header forming plate of the second of the pair of header tanks has two outward bulging portions arranged side by side as spaced apart widthwise thereof and opposed to the respective longitudinally adjacent pairs of outward bulging portions of the first header tank; the tube connecting plate of each of the header tanks being provided with a plurality of tube insertion holes at each of widthwise opposite side portions thereof, the intermediate plate of each header tank being provided with a plurality of communication holes at each of widthwise opposite side portions thereof; the two outward bulging portions of one of two pairs of widthwise arranged outward bulging portions of the first header tank each serving as the refrigerant passing outward bulging portion, the first header tank having a refrigerant inlet communicating with interior of one of the refrigerant passing outward bulging portions and a refrigerant outlet communicating with interior of the other refrigerant passing outward bulging portion, the communication holes of the intermediate plate of the first header tank in communication with one of the two outward bulging portions of the other of said two pairs and the communication holes of the intermediate plate in communication with the other outward bulging portion of said other pair being held in communication by refrigerant turn communication portions formed in the intermediate plate to thereby cause the two outward bulging portions of said other pair to communicate with each other; the two outward bulging portions of the second header tank each serving as the refrigerant passing outward bulging portion.

6) A heat exchanger according to par. 5) wherein the refrigerant inlet is provided at one end of the first header tank, and the refrigerant passageway formed in the intermediate plate so as to communicate with the refrigerant passing outward bulging portion in communication with the refrigerant inlet increases in cross sectional area as the passageway extends away from the refrigerant inlet.

7) A heat exchanger according to par. 5) wherein refrigerant passageways formed in the intermediate plate of the second header tank decrease in cross sectional area toward the downstream side with respect to the direction of flow of the refrigerant.

8) A supercritical refrigeration cycle which comprises a compressor, a gas cooler, an evaporator, a pressure reducing device and an intermediate heat exchanger for subjecting refrigerant flowing out from the gas cooler and refrigerant flowing out from the evaporator to heat exchange, and wherein a supercritical refrigerant is used, the gas cooler comprising a heat exchanger according to any one of pars. 1) to 4).

9) A supercritical refrigeration cycle which comprises a compressor, a gas cooler, an evaporator, a pressure reducing device and an intermediate heat exchanger for subjecting refrigerant flowing out from the gas cooler and refrigerant flowing out from the evaporator to heat exchange, and wherein a supercritical refrigerant is used, the evaporator comprising a heat exchanger according to any one of pars. 1) to 7).

10) A vehicle having installed therein a supercritical refrigeration cycle according to par. 8) as a vehicle air conditioner.

11) A vehicle having installed therein a supercritical refrigeration cycle according to par. 9) as a vehicle air conditioner.

With the heat exchanger according to par. 1), the header forming plate has an outward bulging portion extending longitudinally thereof and having an opening closed with the intermediate plate. This eliminates the need to use caps for closing opposite end openings unlike the header tank of the above-mentioned publication. As a result, the components can be smaller in number, while the work for joining the caps becomes unnecessary, further obviating the work for making the caps as separate members.

If the header forming plate of at least one of the header tanks is provided with a plurality of outward bulging portions, the refrigerant can be caused to flow through the heat exchanger in directions favorable for an improvement in heat exchange performance, without necessitating other members such as partitions.

Furthermore, at least one of all the outward bulging portions serves as a refrigerant passing outward bulging portion for the refrigerant to pass therethrough longitudinally thereof, all the intermediate plate communication holes communicating with the refrigerant passing bulging portion are held in communication by communication portions formed in the intermediate plate, these communication holes and the communication portions provide a refrigerant passageway for causing the refrigerant to flow therethrough longitudinally of the refrigerant passing bulging portion, and the refrigerant passageway is altered in cross sectional area along the direction of length thereof by adjusting the width of the communication portions. Accordingly, the quantities of refrigerant to be passed through portions of the passageway are variable as desired. Consequently, the flows of the refrigerant through all the heat exchange tubes can be set at rates which are favorable to achieve improved heat exchange performance. Moreover, the divided flows of refrigerant through, the heat exchange tubes are adjustable in accordance with the flow velocity distribution of the air to be passed through the air passage clearances between the respective pairs of adjacent heat exchange tubes.

With the heat exchanger described in par. 2), the header forming plate having a bulging portion, the tube connecting plate having tube insertion holes and the intermediate plate having communication holes are each made from a metal plate by press work. This serves to shorten the working time and decrease the number of working steps.

With the heat exchanger according to par. 3), the quantity of refrigerant to be passed through the refrigerant passageway toward the downstream side of the direction of flow can be made smaller than at the upstream side.

With the heat exchanger according to par. 4), the quantity of refrigerant to be passed through the refrigerant passageway toward the downstream side of the direction of flow can be made greater than at the upstream side.

With the heat exchanger according to pars. 5) to 7), the refrigerant can be made to flow favorably to achieve an improved heat exchange efficiency and can be caused to flow through all the heat exchange tubes at uniformalized rates. This enables the heat exchanger to attain an improved heat exchange efficiency when it is used, for example, as an evaporator in supercritical refrigeration cycles.

BEST MODE OF CARRYING OUT THE INVENTION

Embodiments of the present invention will be described below with reference to the drawings. This embodiment is a heat exchanger of the invention as adapted for use as an evaporator for supercritical refrigeration cycles.

Figure 1:
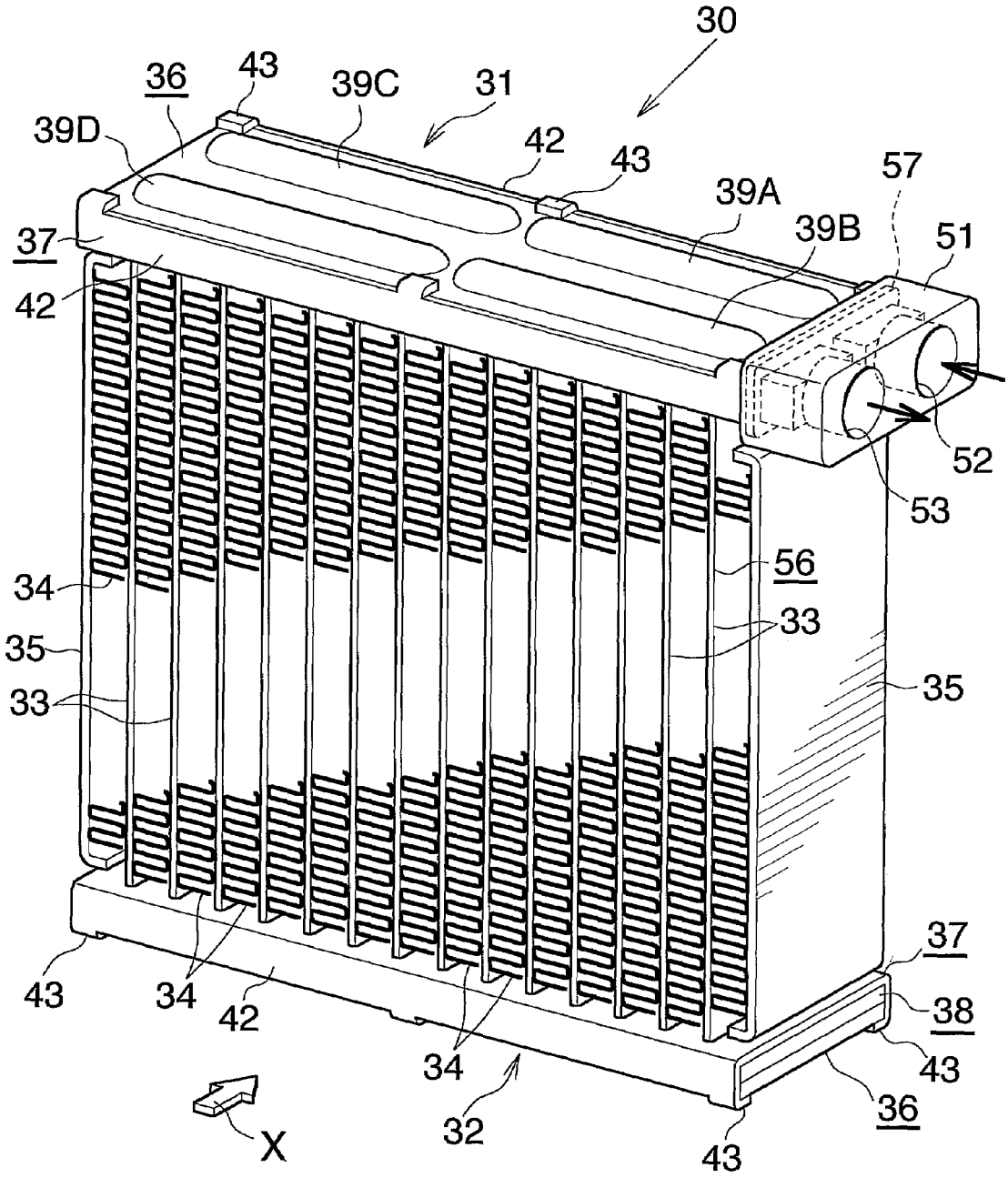
FIG. 1 is a perspective view showing the overall construction of a heat exchanger of the invention for use as an evaporator.
Figure 2:
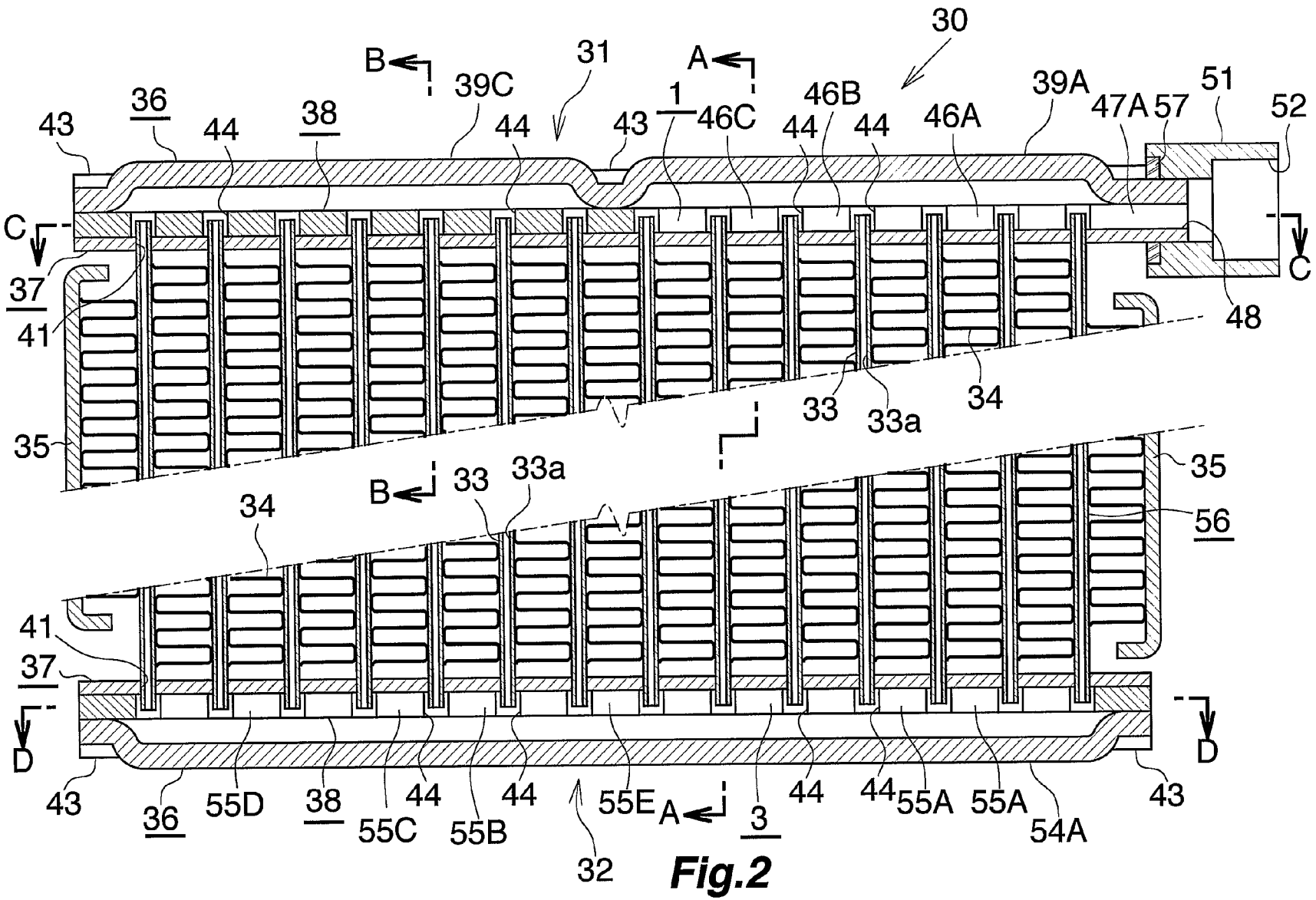
FIG. 2 is a fragmentary view in vertical section showing the evaporator of FIG. 1 as it is seen from behind toward the front.
Figure 3:
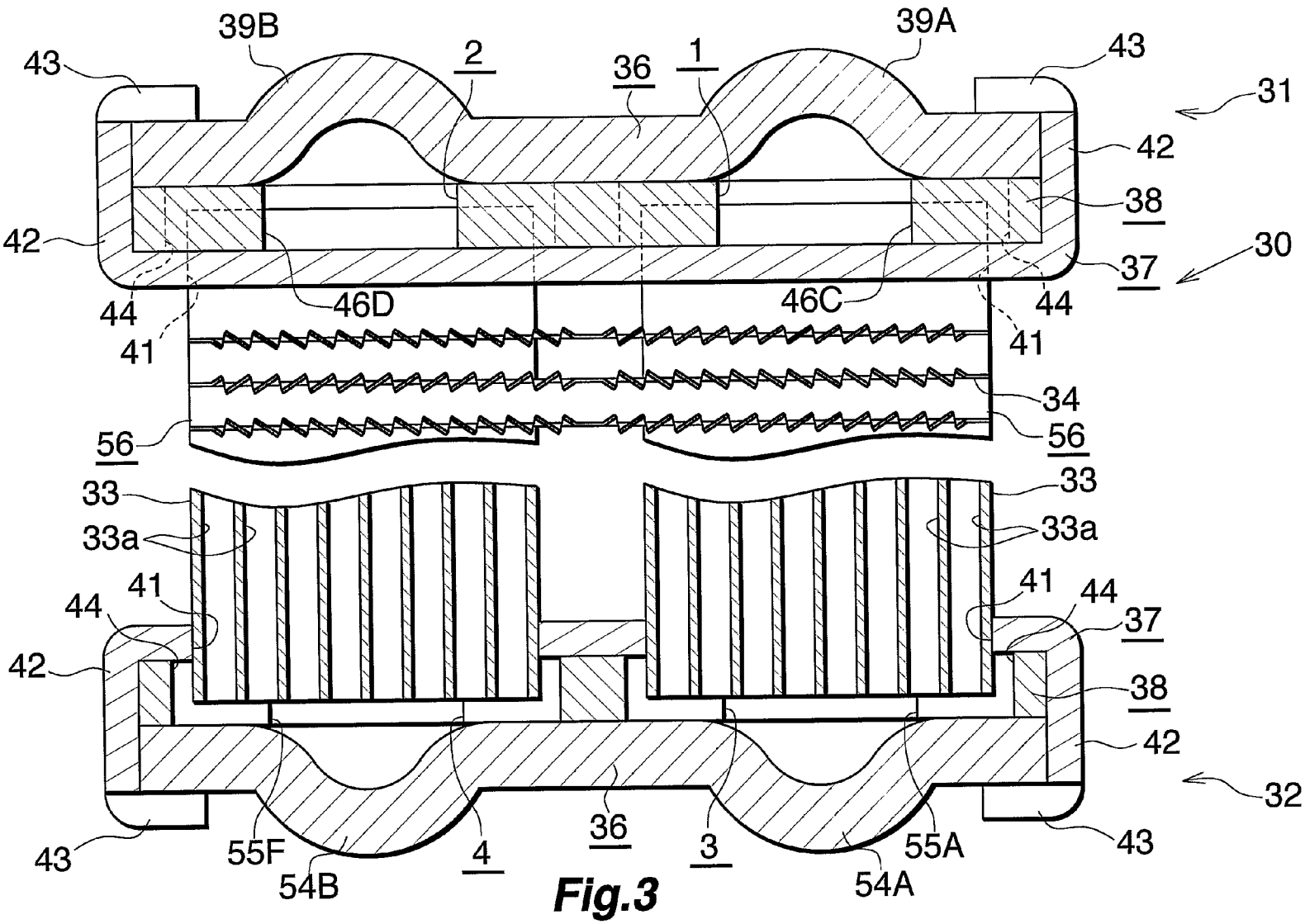
FIG. 3 is an enlarged view in section taken along the line A-A in FIG. 2.
Figure 8:
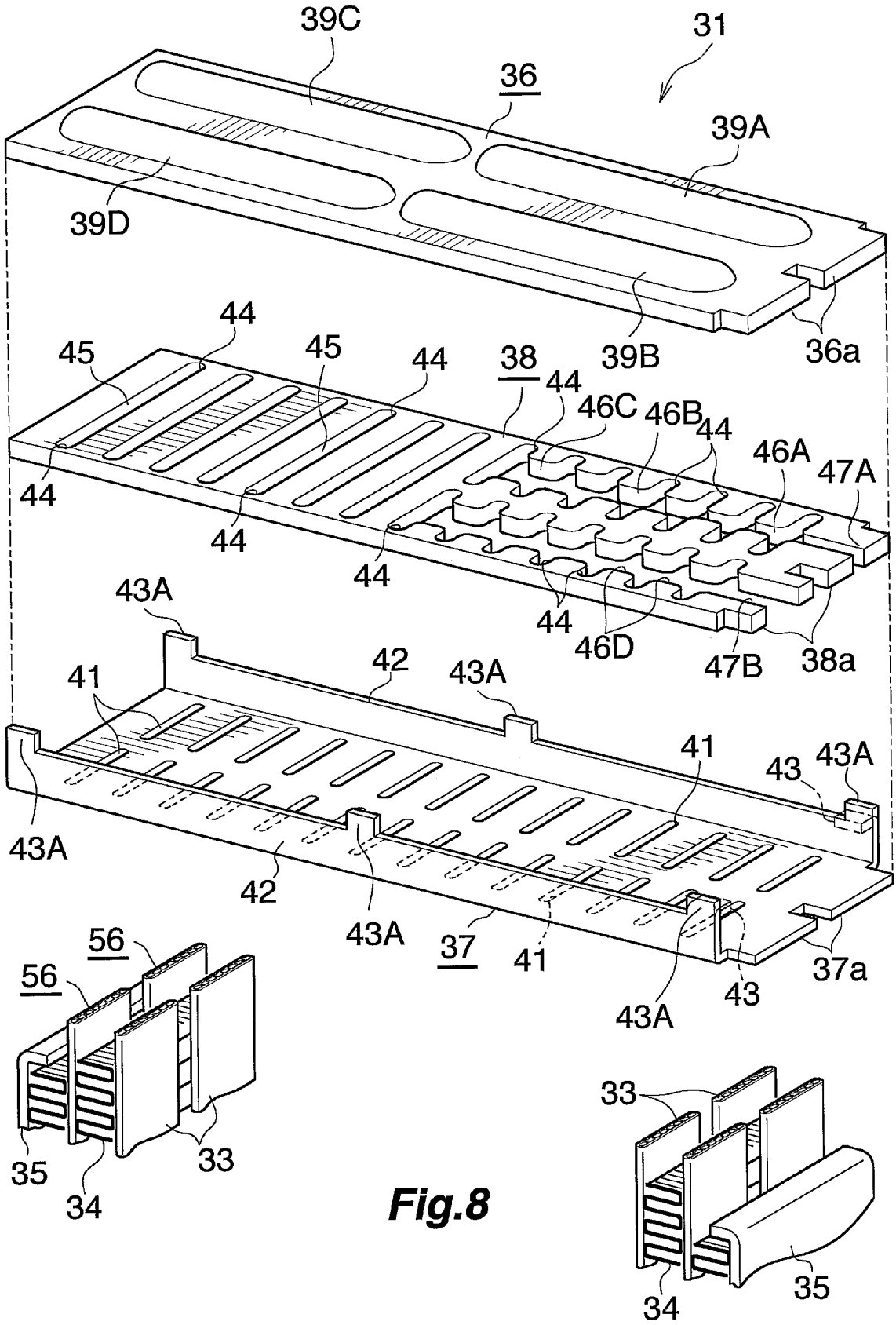
FIG. 8 is an exploded perspective view showing the first header tank of the evaporator of FIG. 1.
Figure 9:
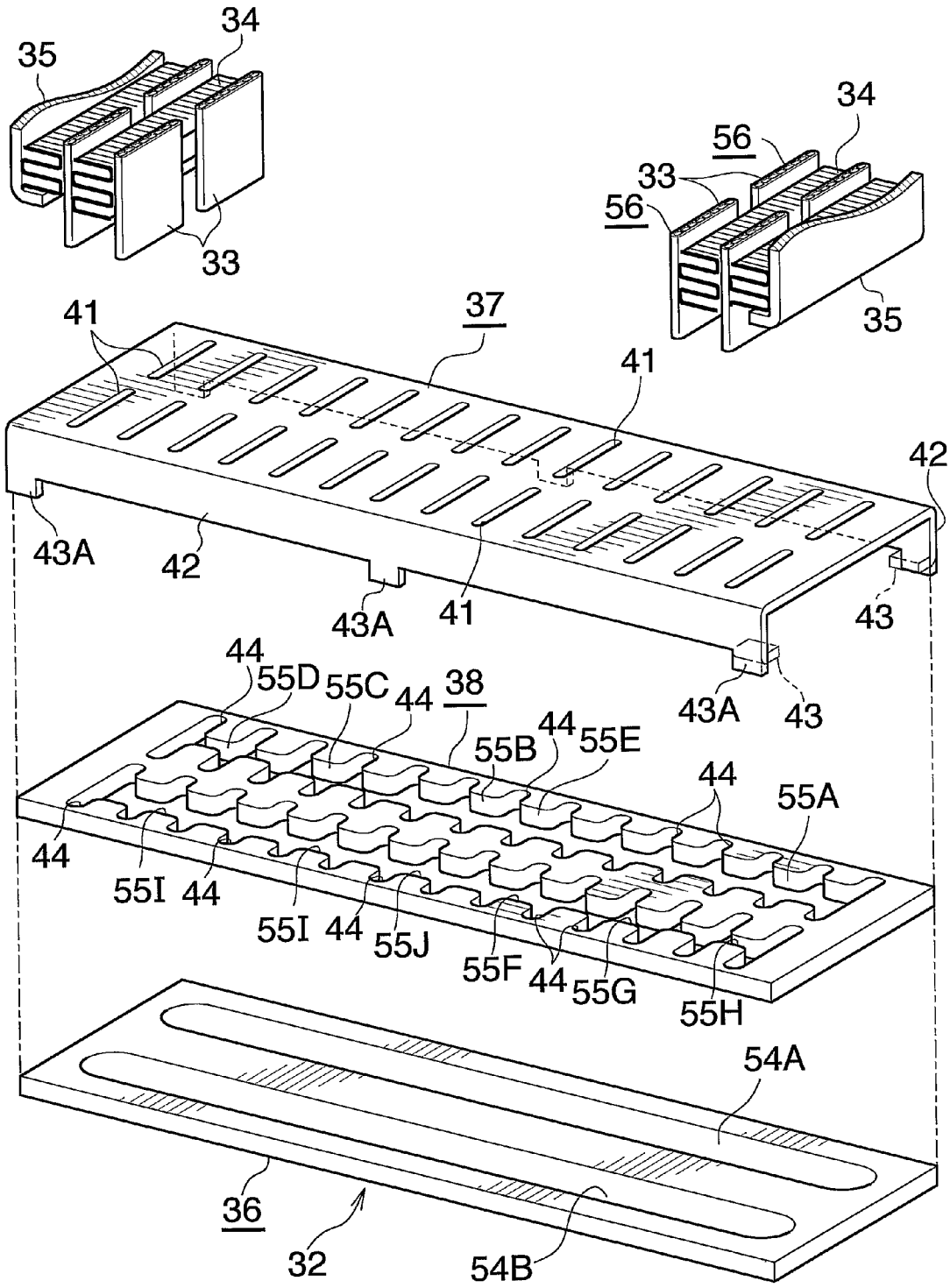
FIG. 9 is an exploded perspective view showing a second header tank of the evaporator of FIG. 1.
Figure 10:
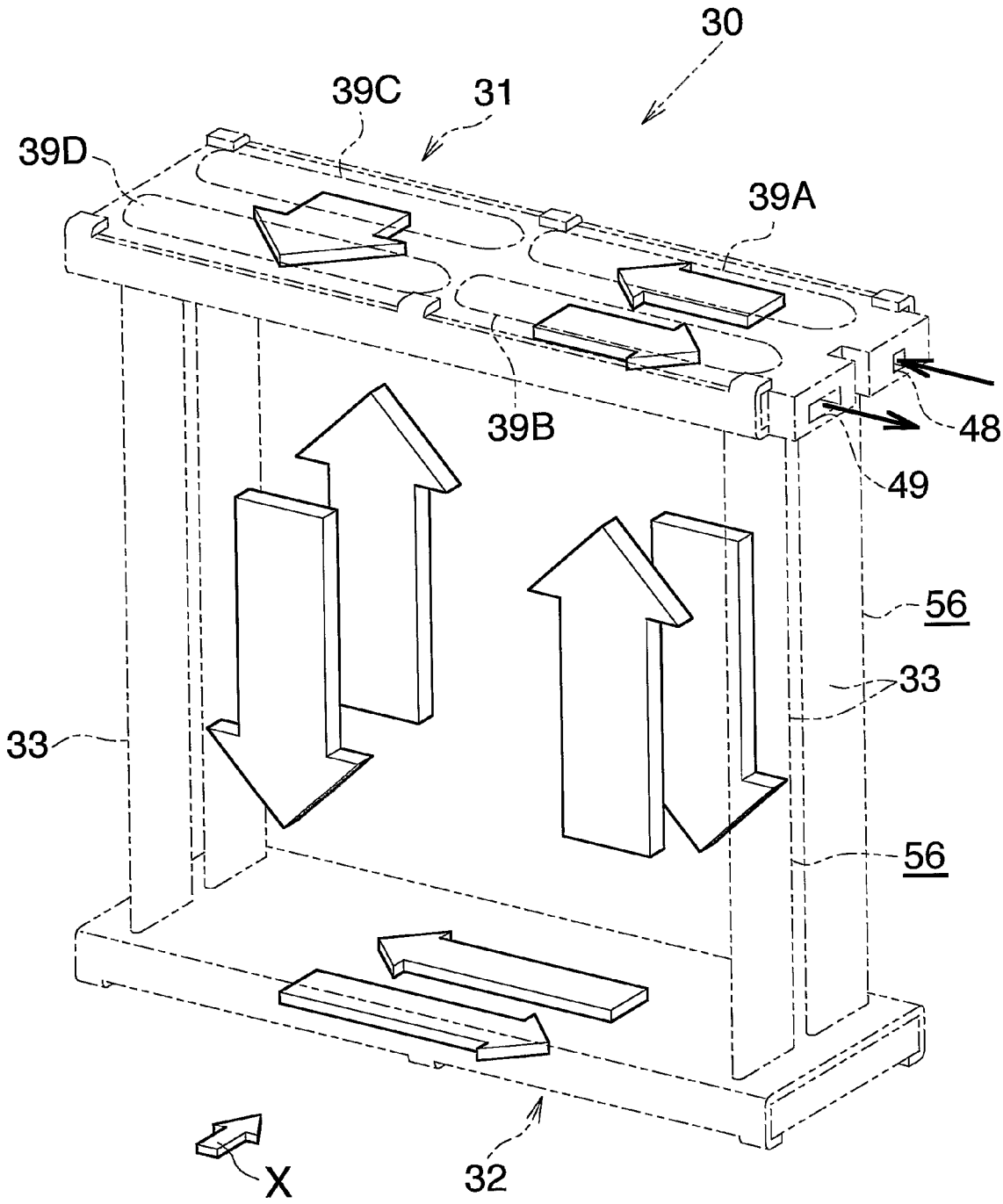
FIG. 10 is a diagram showing the flow of a refrigerant through the evaporator of FIG. 1.

FIGS. 1 to 3 show the overall construction of the evaporator embodying the invention, FIGS. 4 to 9 show the constructions of main portions of the evaporator, and FIG. 10 shows the flow of refrigerant through the evaporator of FIG. 1.

In the following description, the upper, lower, left-hand and right-hand sides of FIGS. 1 and 2 will be referred to as "upper," "lower," "left" and "right," respectively. Further the downstream side (the direction indicated by the arrow X in FIGS. 1 and 10) of flow of air through an air passing clearance between each adjacent pair of heat exchange tubes will be referred to as the "front," and the opposite side as the "rear."

With reference to FIGS. 1 to 3, an evaporator 30 for use in supercritical refrigeration cycles wherein a supercritical refrigerant, such as $CO_2$, is used comprises two header tanks 31, 32 extending in the left-right direction and arranged as spaced part in the upward or downward direction, a plurality of flat heat exchange tubes 33 arranged in parallel in the left-right direction at a spacing between the two header tanks 31, 32, corrugated fins 34 arranged in respective air passing clearances between respective adjacent pairs of heat exchange tubes 33 and outside the heat exchange tubes 33 at the left and right ends of the evaporator and each brazed to the adjacent pair of heat exchange tubes 33 or to the end tube 33, and side plates 35 of aluminum arranged externally of and brazed to the respective fins 34 at the left and right ends. In the case of this embodiment, the upper header tank 31 will be referred to as the "first header tank," and the lower header tank 32 as the "second header tank."

The first header tank 31 comprises a header forming plate 36 made from a brazing sheet having a brazing material layer over opposite surfaces thereof, i.e., an aluminum brazing sheet according to the present embodiment, a tube connecting plate 37 made from a brazing sheet having a brazing material layer over opposite surfaces thereof, i.e., an aluminum brazing sheet according to the present embodiment, and an intermediate plate 38 interposed between the header forming plate 36 and the tube connecting plate 37 and made from a bare metal material, i.e., a bare aluminum material, the plates 36 to 38 being arranged in superposed layers and brazed to one another.

The header forming plate 36 of the first header tank 31 has a right portion and a left portion which are provided with two outward bulging portions 39A, 39B and two outward bulging portions 39C, 39D, respectively. The two bulging portions in each of the right and left plate portions extend in the left-right direction and are spaced apart in the front-rear direction. In the present embodiment, the bulging portion 39A in the right front plate portion will be referred to as the "first outward bulging portion," the bulging portion 39B in the right rear plate portion as the "second outward bulging portion," the bulging portion 39C in the left front plate portion as the "third outward bulging portion," and the bulging portion 39D in the left rear plate portion as the "fourth outward bulging portion." The bulging portions 39A to 39D have respective openings facing down and closed with the intermediate plate 38. The bulging portions 39A to 39D are equal in bulging height, length and width. The first and second outward bulging portions 39A, 39B each serve as a refrigerant passing outward bulging portion for causing $CO_2$ to flow therethrough longitudinally thereof. The header forming plate 36 is made from an aluminum brazing sheet having a brazing material layer over opposite surfaces thereof by press work.

The tube connecting plate 37 is provided in each of front and rear opposite side portions thereof with a plurality of tube insertion holes 41 elongated in the front-rear direction, arranged in the left-right direction at a spacing and extending through the thickness of the plate 37. The tube insertion holes 41 in the front right half portion are formed within the left-to-right range of the first outward bulging portion 39A of the header forming plate 36, the tube insertion holes 41 in the rear right half portion are formed within the left-to-right range of the second outward bulging portion 39B, the tube insertion holes 41 in the front left half portion are formed within the left-to-right range of the third outward bulging portion 39C, and the tube insertion holes 41 in the rear left half portion are formed within the left-to-right range of the fourth outward bulging portion 39D. The tube insertion holes 41 have a length slightly larger than the front-to-rear width of the bulging portions 39A to 39D, and have front and rear end portions projecting outward beyond the respective front and rear side edges of the corresponding bulging portions 39A to 39D (see FIGS. 3 and 4).

The tube connecting plate 37 is integrally provided at each of its front and rear side edges with a cover wall 42 projecting upward to the outer surface of the header forming plate 36, covering the boundary between the plate 36 and the intermediate plate 38 over the entire length thereof and brazed to the front or rear side faces of the plates 36, 38. The projecting end of the cover wall 42 is integrally provided with engaging portions 43 arranged in the left-right direction at a spacing, engaging with the outer surface of the plate 36 and brazed to the header forming plate 36. The tube connecting plate 37 is made from an aluminum brazing sheet having a brazing material layer over opposite surfaces thereof by press work.

The intermediate plate 38 has communication holes 44 positioned in corresponding relation with the respective tube insertion holes 41 in the tube connecting plate 37, extending through the thickness thereof and equal in number to the number of tube insertions holes 41 for causing the holes 41 to communicate with one of the outward bulging portions 39A to 39D of the header forming plate 36 therethrough in corresponding relation. The communication holes 44 are substantially larger than the insertion holes 41. The tube insertion holes 41 in the front right half portion of the tube connecting plate 37 are held in communication with the interior of the first outward bulging portion 39A through the communication holes 44 in the front right half portion of the intermediate plate 38. The tube insertion holes 41 in the rear right half portion of the plate 37 are held in communication with the interior of the second outward bulging portion 39B through the communication holes 44 in the rear right half portion of the intermediate plate 38. The tube insertion holes 41 in the front left half portion of the plate 37 are held in communication with the interior of the third outward bulging portion 39C through the communication holes 44 in the front left half portion of the intermediate plate 38. The tube insertion holes 41 in the rear left half portion of the plate 37 are held in communication with the interior of the fourth outward bulging portion 39D through the communication holes 44 in the rear left half portion of the intermediate plate 38.

Figure 4:
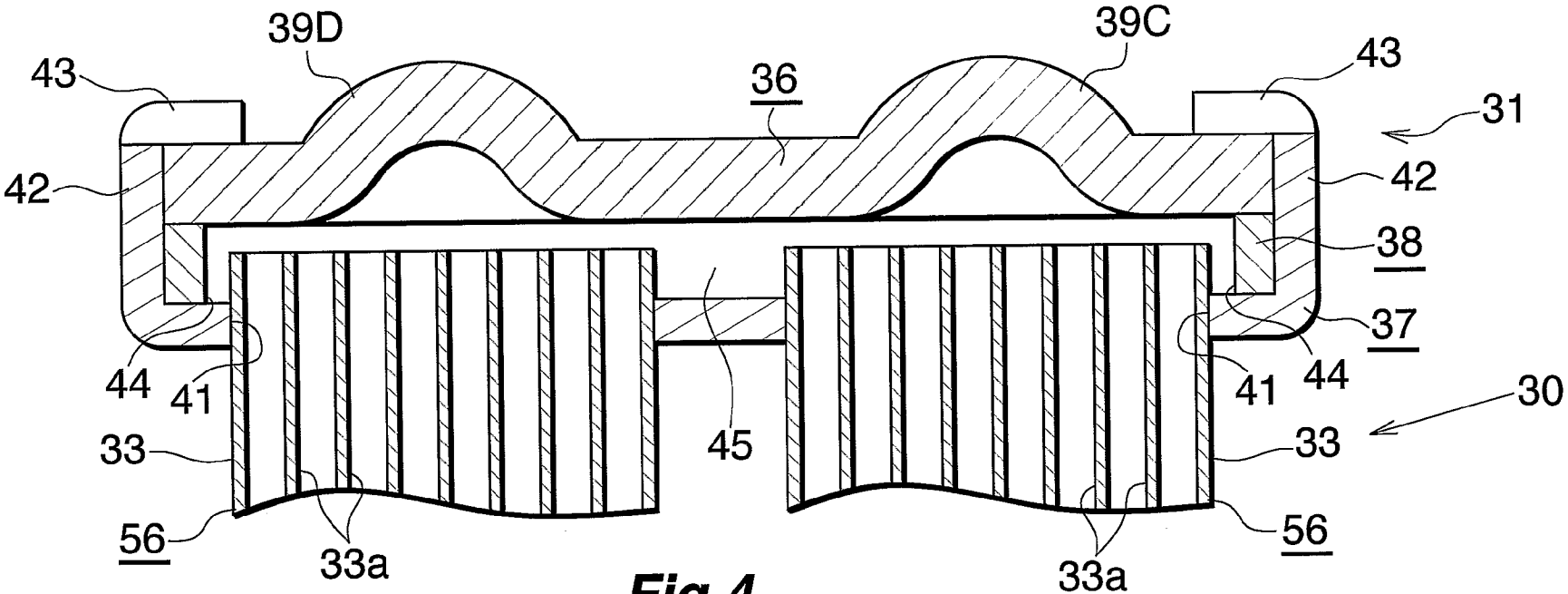
FIG. 4 is an enlarged view in section taken along the line B-B in FIG. 2.
Figure 5:
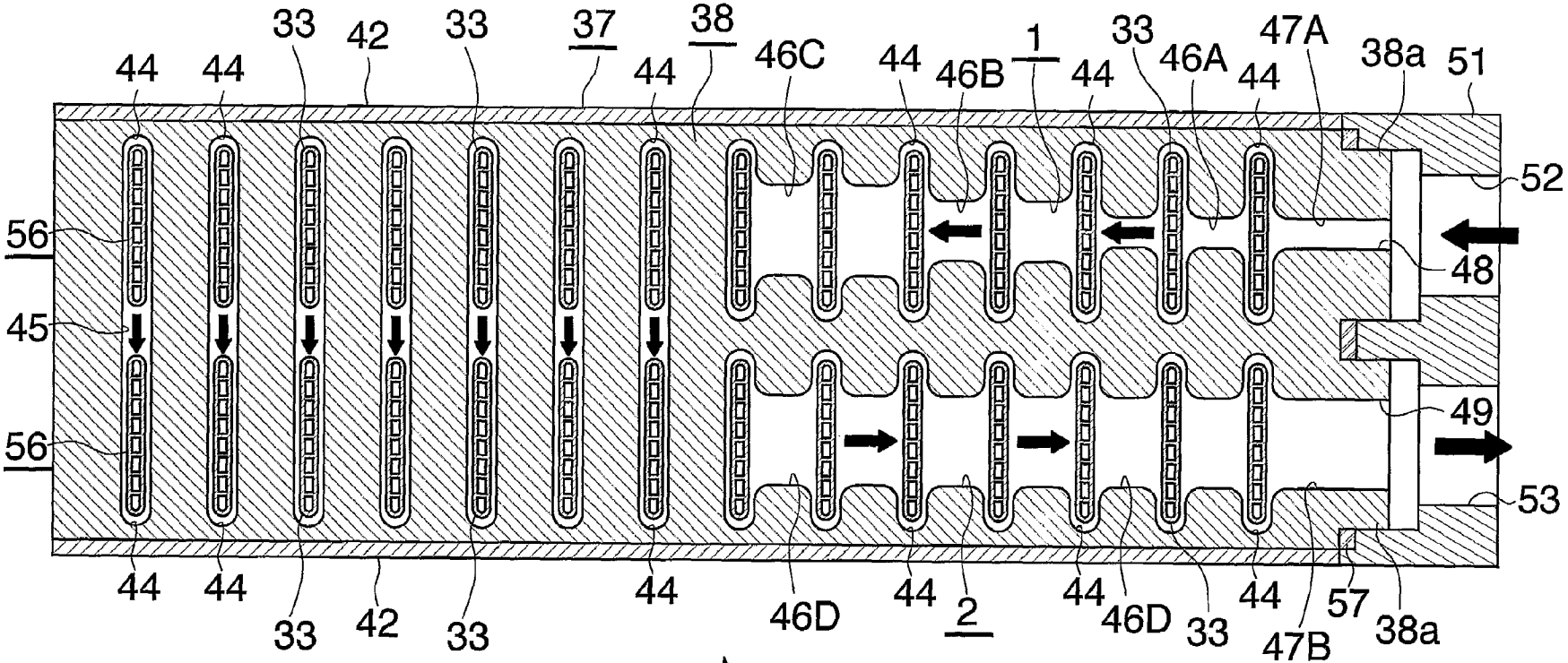
FIG. 5 is an enlarged view in section taken along the line C-C in FIG. 2.

With reference to FIGS. 4 and 5, the communication holes 44 of the intermediate plate 38 in communication with the third bulging portion 39C are caused to communicate with the respective communication holes 44 of the plate 38 communicating with the fourth bulging portion 39D by refrigerant turn communication portions 45 formed by cutting away the portions between respective front-to-rear adjacent pairs of communication holes 44 in the intermediate plate 38, whereby the interior of the third bulging portion 39C and the interior of the fourth bulging portion 39D are caused to communicate with each other. All the communication holes 44 communicating with the interior of the first bulging portion 39A, as well as all the communication holes 44 communicating with the interior of the second bulging portion 39B, are held in communication through communication portions 46A, 46B, 46C or 46D formed by removing the portions between respective left-to-right adjacent pairs of communication holes 44 in the intermediate plate 38 (see FIG. 5). All communication holes 44 communicating with the interior of the first outward bulging portion 39A and the communication portions 45A to 45C holding these holes 44 in communication provide a first refrigerant passageway 1. All communication holes 44 communicating with the interior of the second outward bulging portion 39B and the communication portions 45D holding these holes 44 in communication provide a second refrigerant passageway 2. All the communication portions 46A to 46C providing the first refrigerant passageway 1 are in groups each comprising adjacent communication portions. The communication portions 46A, 46B or 46C in each group are equal in front-to-rear width. The communication portions 46A to 46C gradually increase in this width from group to group in the right-to-left direction. Accordingly, the first refrigerant passageway 1 increases in cross sectional area toward the downstream side with respect to the direction of flow of the refrigerant, i.e., toward the left end. All the communication portions 46D providing the second refrigerant passageway 2 are equal in width. For example, the width of these portions 46D are equal to that of the communication portions 46C of the first passageway 1 in the left-end group. The intermediate plate 38 is made from a bare aluminum material by press work.

Figure 6:
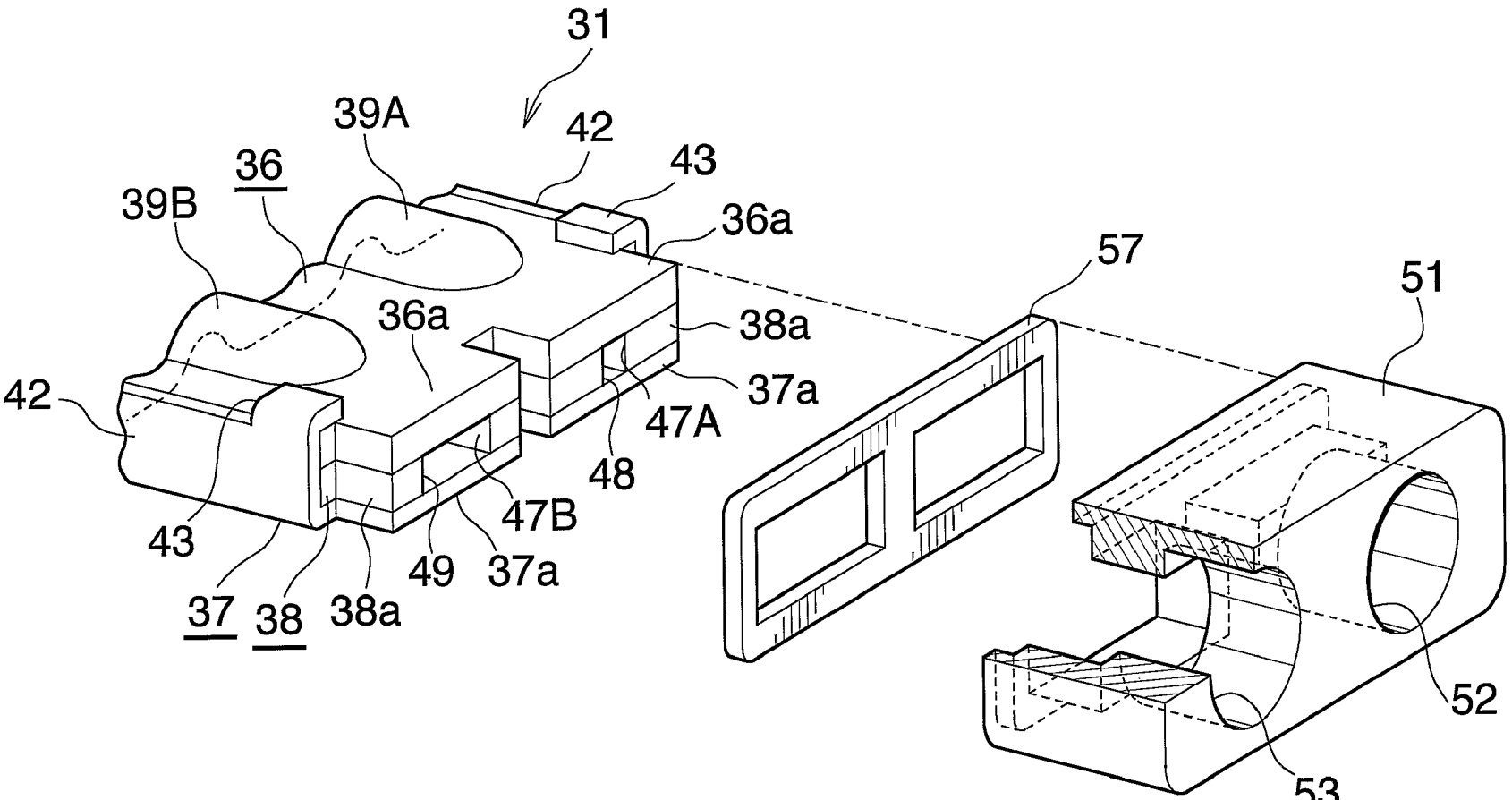
FIG. 6 is an exploded perspective view showing a right end portion of a first header tank of the evaporator of FIG. 1.
Figure 7:
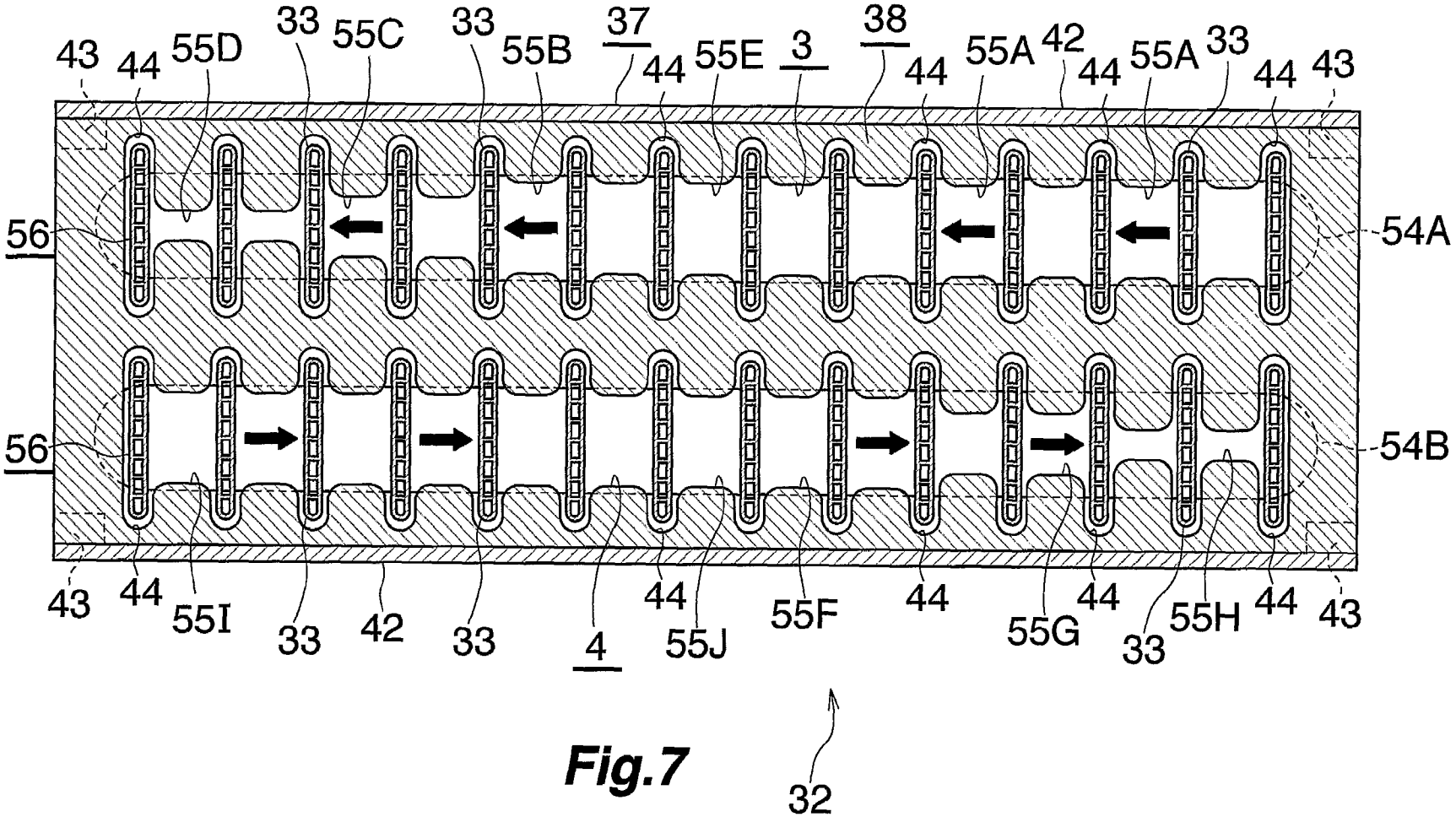
FIG. 7 is an enlarged view in section taken along the line D-D in FIG. 2.

With reference to FIGS. 5 and 6, each of the three plates 36, 37, 38 is provided at the right end thereof with two rightward projections 36*a* (37*a*, 38*a*) spaced apart in the front-rear direction. The intermediate plate 38 has cutouts 47A, 47B extending from the outer ends of the front and rear two outward projections 38*a* to the communication holes 44 at the right end. These cutouts 47A, 47B provide in the first header tank 31 a refrigerant inlet 48 communicating with the first refrigerant passageway 1 and the interior of the first outward bulging portion 39A and a refrigerant outlet 49 communicating with the second refrigerant passageway 2 and the interior of the second outward bulging portion 39B. With the refrigerant inlet 48 provided at the right end of the first header tank 31, the cross sectional area of the first refrigerant passageway 1 gradually increases as the passageway extends away from the inlet 48. The front cutout 47A is equal to the communication portions 46A in the right-end group constituting the first passageway 1 in front-to-rear width. A refrigerant inlet-outlet member 51 having a refrigerant inflow channel 52 communicating with the inlet 48 and a refrigerant outflow channel 53 communicating with the outlet 49 is brazed to the first header tank 31 with a brazing sheet having a brazing material layer over opposite surfaces thereof, i.e., an aluminum brazing sheet 57, so as to be positioned alongside the pairs of rightward projections 36*a*, 37*a*, 38*a* of the three plates 36, 37, 38. The inlet-outlet member 51 is made from a bare metal material, i.e., a bare aluminum material.

With reference to FIGS. 1 to 3 and 7, the second header tank 32 has nearly the same construction as the first header tank 31, and like parts will be designated by like reference numerals throughout the drawings concerned. The header tanks 31, 32 are arranged with their tube connecting plates 37 facing toward each other. The second header tank 32 differs from the fist header tank 31 in that the header forming plate 36 has two outward bulging portions 54A, 54B extending from a right end portion thereof to a left end portion thereof and spaced apart in the front-rear direction so as to be opposed to both the first and third bulging portions 39A, 39C and both the second and fourth bulging portions 39B, 39D, respectively, that all the communication holes 44 communicating with each of the bulging portions 54A, 54B are held in communication through communication portions 55A to 55E or 55F to 55J formed by removing the portions between respective left-to-right adjacent pairs of communication holes 44 in the intermediate plate 38, that all communication holes 44 communicating with the interior of the front outward bulging portion 54A and the communication portions 55A to 55E holding these holes 44 in communication provide a front refrigerant passageway 3, that all communication holes 44 communicating with the interior of the rear outward bulging portion 54B and the communication portions 55F to 55J holding these holes 44 in communication provide a rear refrigerant passageway 4, that the two bulging portions 54A, 54B are not in communication and that the right ends of the three plates 36, 37, 38 are provided with no rightward projections. The bulging portions 54A, 54B are equal to the bulging portions 39A to 39D of the first header tank 31 with respect to each of the bulging height and width. The front and rear outward bulging portions 54A, 54B each serve as a refrigerant passing outward bulging portion for causing $CO_2$ to flow therethrough longitudinally thereof.

The communication portions 55A to 55E providing the front refrigerant passageway 3 include those 55A through which the communication holes 44 having inserted therein the lower ends of the heat exchange tubes 33 communicating with the interior of the first outward bulging portion 39A communicate with one another. All of these communication portions 55A are equal in front-to-rear width. The communication portions 55A to 55E providing the front refrigerant passageway 3 include those 55B, 55C, 55D through which the communication holes 44 having inserted therein the lower ends of the heat exchange tubes 33 communicating with the interior of the third outward bulging portion 39C communicate with one another. All of these communication portions 55B, 55C, 55D are in groups each comprising adjacent communication portions. The communication portions 55B, 55C or 55D in each group are equal in front-to-rear width. The communication portions 55B to 55D gradually decrease in this width from group to group in the right-to-left direction. In front-to-rear width, the communication portions 55B of the right-end group are equal to those 55A through which the communication holes 44 having inserted therein the lower ends of the heat exchange tubes 33 communicating with the interior of the first outward bulging portion 39A communicate with one another. Further the communication hole 44 having inserted therein the lower end of the left-end heat exchange tube 33 communicating with the interior of the first outward bulging portion 39A communicates with the communication hole 44 having inserted therein the lower end of the right-end heat exchange tube 33 communicating with the interior of the third outward bulging portion 39C, through the communication portion 55E, which is equal to the communication portions 55A positioned on the right side of the portion 55E in front-to-rear width. Accordingly, the third refrigerant passageway 3 decreases in cross sectional area toward the downstream side with respect to the direction of flow of the refrigerant, i.e., toward the left end.

The communication portions 55F to 55J providing the rear refrigerant passageway 4 include those 55F, 55G, 55H through which the communication holes 44 having inserted therein the lower ends of the heat exchange tubes 33 communicating with the interior of the second outward bulging portion 39B communicate with one another. All of these communication portions 55F, 55G, 55H are in groups each comprising adjacent communication portions. The communication portions 55F, 55G or 55H in each group are equal in front-to-rear width. The communication portions 55F to 55H gradually decrease in this width from group to group in the left-to-right direction. The communication portions 55F to 55J providing the rear refrigerant passageway 4 include those 55I through which the communication holes 44 having inserted therein the lower ends of the heat exchange tubes 33 communicating with the interior of the fourth outward bulging portion 39D communicate with one another. All of these communication portions 55I are equal in front-to-rear width. In front-to-rear width, the communication portions 55F of the left-end group are equal to those 55I through which the communication holes 44 having inserted therein the lower ends of the heat exchange tubes 33 communicating with the interior of the fourth outward bulging portion 39H communicate with one another. Further the communication hole 44 having inserted therein the lower end of the left-end heat exchange tube 33 communicating with the interior of the second outward bulging portion 39A communicates with the communication hole 44 having inserted therein the lower end of the right-end heat exchange tube 33 communicating with the interior of the fourth outward bulging portion 39C, through the communication portion 55J, which is equal to the communication portions 55I positioned on the left side of the portion 55J in front-to-rear width. Accordingly, the fourth refrigerant passageway 4 decreases in cross sectional area toward the downstream side with respect to the direction of flow of the refrigerant, i.e., toward the right end.

The header tanks 31, 32 are made in the manner shown in FIGS. 8 and 9.

First, an aluminum brazing sheet having a brazing material layer over opposite surfaces thereof is subjected to press work to make header forming brazing plates 36 having outward bulging portions 39A to 39D, or 54A, 54B. Tube connecting plates 37 each having tube insertion holes 41, cover walls 42 and engaging portion forming lugs 43A extending straight from each of the cover walls 42 are made from an aluminum brazing sheet having a brazing material layer over opposite surfaces thereof by press work. Intermediate plates 38 having communication holes 44, and communication portions 45, 46A to 46D or 55A to 55J are further made from a bare aluminum material by press work. Rightward projections 36*a*, 47*a*, 48*a* and cutouts 47 are formed on or in the header forming plate 36, intermediate plate 38 and tube connecting plate 37 for the first header tank 31. Cutouts 47A, 47B are formed also in the intermediate plate 38.

The three plates 36, 37, 38 for each of the header tanks 31, 32 are then fitted together in superposed layers, the lugs 43A are thereafter bent to form engaging portions 43, and the engaging portions 43 are caused to engage with the header forming plate 36. In this way, each of two tacked assemblies is obtained. Utilizing the brazing material layers of the plates 36, 37, the three plates 36, 37, 38 of each assembly are then brazed to one another, the cover walls 42 are brazed to the front and rear side faces of the intermediate plate 38 and header forming plate 36, and the engaging portions 43 are brazed to the plate 36. Thus, the two header tanks 31, 32 are made.

Each of the heat exchange tubes 33 is made from a metal extrudate, i.e., an aluminum extrudate in the present embodiment, is in the form of a flat tube having an increased width in the front-rear direction and has inside thereof a plurality of refrigerant channels 33*a* extending longitudinally thereof and arranged in parallel. The heat exchange tubes 33 are brazed to the tube connecting plates 37 of the two header tanks 31, 32 using the brazing material layers of the plates 37, with their opposite ends placed into the respective tube insertion holes 41 of the tanks 31, 32. Each end of the tube 33 is placed into the communication hole 44 of the intermediate plate 38 to an intermediate portion of the thickness thereof (see FIG. 3). Between the two header tanks 31, 32, a plurality of tube groups 56, each comprising a plurality of heat exchange tubes 33 arranged in parallel in the left-right direction at a spacing, are arranged in rows, i.e., in two rows as spaced apart in the front-rear direction. The heat exchange tubes 33 positioned in the right half of the front tube group 56 have upper and lower ends which are joined to the respective header tanks 31, 32 so as to communicate with the interior of the first bulging portion 39A and the interior of the front bulging portion 54A. The heat exchange tubes 33 positioned in the left half of the front tube group 56 have upper and lower ends which are joined to the respective header tanks 31, 32 so as to communicate with the interior of the third bulging portion 39C and the interior of the front bulging portion 54A. The heat exchange tubes 33 positioned in the right half of the rear tube group 56 have upper and lower ends which are joined to the respective header tanks 31, 32 so as to communicate with the interior of the second bulging portion 39B and the interior of the rear bulging portion 54B. The heat exchange tubes 33 positioned in the left half of the rear tube group 56 have upper and lower ends which are joined to the respective header tanks 31, 32 so as to communicate with the interior of the fourth bulging portion 39D and the interior of the rear bulging portion 54B.

Each of the corrugated fins 34 is made in a wavy form from an aluminum brazing sheet having a brazing material layer over opposite surfaces thereof. Connecting portions interconnecting crest portions and furrow portions of the fin are provided with a plurality of louvers arranged in parallel in the front-rear direction. The corrugated fin 34 is used in common for the front and rear tube groups 56 and has a front-to-rear width which is approximately equal to the distance from the front edge of heat exchange tube 33 of the front tube group 56 to the rear edge of the corresponding heat exchange tube 33 of the rear tube group 56. Instead of using one corrugated fin 34 for the front and rear tube groups 56 in common, a corrugated fin may be provided between each adjacent pair of heat exchange tubes 33 in each of the tube groups 56.

The evaporator 30 is fabricated by preparing the above-mentioned two tacked assemblies for making two header tanks 31, 32, heat exchanges tubes 33 and corrugated fins 34; arranging the two tacked assemblies as spaced apart with their tube connecting plates 37 opposed to each other; arranging the heat exchange tubes 33 and the corrugated fins 34 alternately; inserting opposite ends of the heat exchange tubes 33 into the respective tube insertion holes 41 of the tube connecting plates 37 of the two tacked assemblies; arranging side plates 35 externally of the respective corrugated fins 34 at opposite ends of the resulting arrangement; placing a refrigerant inlet-outlet member 51 as opposed to all the three plates 36, 37, 38 along with an intervening brazing sheet 57 for the header tank 31 to be made; and brazing the three plates 36, 37, 38 of each tacked assembly to make header tanks 31, 32, and brazing the heat exchange tubes 33 to the header tanks 31, 32, each fin 34 to the heat exchange tubes 33 adjacent thereto, each side plate 35 to the fin 34 adjacent thereto, and the inlet-outlet member 51 to the first header tank 31 simultaneously with the brazing of each tacked assembly.

The evaporator 30 provides a supercritical refrigeration cycle along with a compressor, gas cooler, pressure reducing device and an intermediate heat exchanger for subjecting the refrigerant flowing out from the gas cooler and the refrigerant flowing out from the evaporator to heat exchange, and the refrigeration cycle is installed in vehicles, for example, in motor vehicles, as a motor vehicle air conditioner.

With the evaporator 30 described above, $CO_2$ reduced in pressure upon passing through an expansion valve serving as a pressure reducing device flows through the refrigerant inflow channel 52 of the inlet-outlet member 51 and through the inlet 48 and the first refrigerant passageway 1 of the first header tank 31, flows into the first outward bulging portion 39A of the tank, flows leftward through the passageway land the bulging portion 39A, and thereafter flows into the refrigerant channels 33*a* of all the heat exchange tubes 33 in communication with the interior of the first outward bulging portion 39A as shown in FIG. 10.

At this time, the $CO_2$ which is in liquid phase tends to readily flow into the channels 33*a* of the heat exchange tubes 33 closer to the inlet 48, but since the first refrigerant passageway 1 increases in cross sectional area toward the left end, a large amount of $CO_2$ flows leftward through the passageway 1 and the bulging portion 39A. This uniformalizes the rate of flow of $CO_2$ through the channels 33*a* of all the tubes 33 communicating with the interior of the first bulging portion 39A.

The $CO_2$ flowing into the channels 33*a* of all the tubes 33 communicating with the interior of the first bulging portion 39 flows down the channels 33*a* and enters the front outward bulging portion 54A of the second header tank 32. The $CO_2$ in the portion 54A flows leftward through this portion 54A and the front refrigerant passageway 3 of the intermediate plate 38 and then dividedly flows into the channels 33*a* of all the heat exchange tubes 33 in communication with the interior of the third outward bulging portion 39C.

Since the channels 33*a* of all the tubes 33 communicating with the interior of the first bulging portion 39A are made uniform in the rate of flow of $CO_2$ therethrough, the right side portion of the front refrigerant passageway 3 and the right side portion of the front outward bulging portion 54A are made uniform in the quantities of $CO_2$ therein at this time, whereas the $CO_2$ tends to readily flow leftward by virtue of inertia in the left side portion of the front passageway 3 and in the left side portion of the front bulging portion 54A. Consequently the $CO_2$ is likely to smoothly flow into the channels 33*a* of the heat exchange tubes 33 positioned closer to the left end, among all the heat exchange tubes 33 communicating with the third outward bulging portion 39C. However, since the left side portion of the front passageway 3 decreases toward the left end in cross sectional area, this offers resistance to the flow of $CO_2$, permitting the $CO_2$ to uniformly dividedly flow into all tubes 33 communicating with the interior of the third bulging portion 39C.

The $CO_2$ in the third bulging portion 39C changes its course, flows upward through the channels 33*a* and enters the third outward bulging portion 39C of the first header tank 31. The $CO_2$ in the bulging portion 39C flows through the refrigerant turn communication portions 45 of the intermediate plate 38 of the first header tank 31 into the fourth outward bulging portion 39D, dividedly flows into the channels 33*a* of all the heat exchange tubes 33 communicating with the fourth bulging portion 39D, changes its course, flows down the channels 33*a* and enters the rear outward bulging portion 54B of the second header tank 32. The $CO_2$ then flows rightward through this portion 54B and the rear refrigerant passageway 4, dividedly flows into the channels 33*a* of all the heat exchange tubes 33 communicating with the second outward bulging portion 39B.

Since all the heat exchange tubes 33 communicating with the interior of the fourth bulging portion 39D are made uniform in the rate of flow of $CO_2$ therethrough, the left side portion of the rear refrigerant passageway 4 and the left side portion of the rear outward bulging portion 54B are made uniform in the quantities of $CO_2$ therein at this time, whereas the $CO_2$ tends to readily flow rightward by virtue of inertia in the right side portion of the rear passageway 4 and in the right side portion of the rear bulging portion 54B. Consequently the $CO_2$ is likely to smoothly flow into the channels 33*a* of the heat exchange tubes 33 positioned closer to the right end, among all the heat exchange tubes 33 communicating with the second outward bulging portion 39B. However, since the right side portion of the rear passageway 4 decreases toward the right end in cross sectional area, this offers resistance to the flow of $CO_2$, permitting the $CO_2$ to uniformly dividedly flow into all tubes 33 communicating with the interior of the second bulging portion 39C.

The $CO_2$ in all the heat exchange tubes 33 communicating with the second bulging portion 39B changes its course, flows up through the channels 33*a* and enters the second outward bulging portion 39B of the first header tank 31. The $CO_2$ thereafter flows out of the evaporator 30 via the second bulging portion 39B, the second refrigerant passageway 2, the outlet 49 and the outflow channel 53 of the inlet-outlet member 51. While flowing through the channels 33*a* of the heat exchange tubes 33, the $CO_2$ is subjected to heat exchange with the air flowing through the air passing clearances in the direction indicated by the arrow X in FIGS. 1 and 10 and flows out from the evaporator in a vapor phase.

The heat exchanger embodying the invention as described above is used as the evaporator of a supercritical refrigeration cycle, whereas this use is not limitative; the heat exchanger of the invention may be used, for example, as a gas cooler in supercritical refrigeration cycles Although $CO_2$ is used as the supercritical refrigerant of the supercritical refrigeration cycle according to the foregoing embodiment, the refrigerant is not limited to this gas but ethylene, ethane, nitrogen oxide or the like is alternatively used.

FIGS. 11 to 17 show modified heat exchange tubes for use in the evaporator 30 according to the above embodiment.

Figure 11:
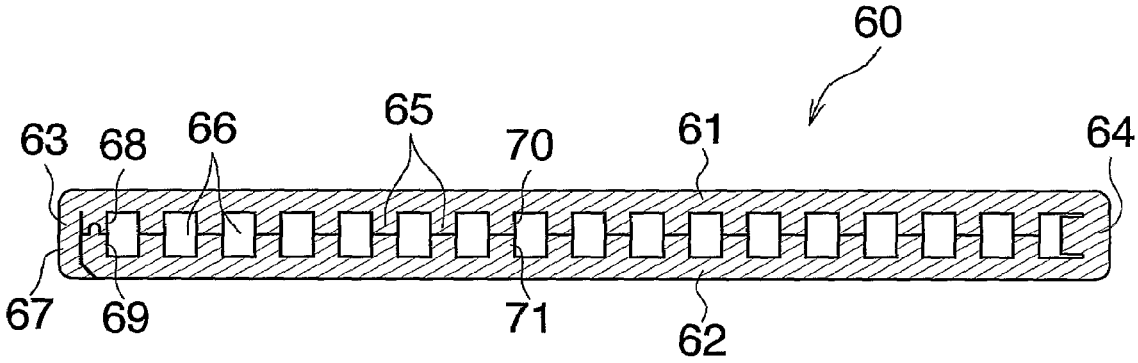
FIG. 11 is a view in cross section showing a first modification of heat exchange tube.
Figure 12:
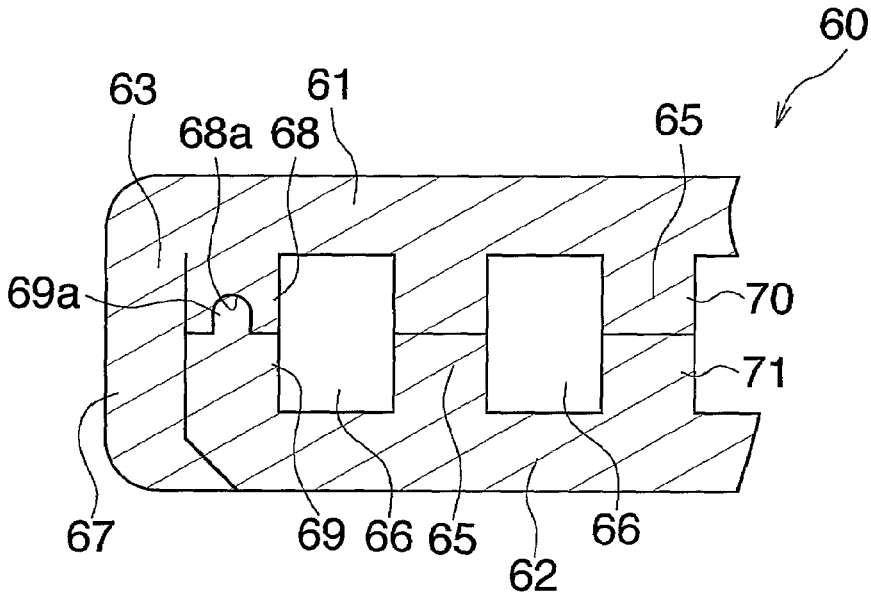
FIG. 12 is a fragmentary enlarged view of FIG. 11.

FIGS. 11 and 12 show a heat exchange tube 60 which comprises a pair of upper and lower flat walls 61, 62 (a pair of flat walls) opposed to each other, left and right opposite side walls 63, 64 interconnecting the upper and lower walls 61, 62 at their left and right side edges, and a plurality of reinforcing walls 65 interconnecting the upper and lower walls 61, 62 between opposite side walls 63, 64, extending longitudinally of the tube and spaced from one another by a predetermined distance. The tube 60 has in its interior a plurality of refrigerant channels 66 arranged widthwise thereof in parallel. The reinforcing wall 65 serves as a partition wall between each adjacent pair of refrigerant channels 66. The channels 66 are equal in width over the entire height thereof.

The left side wall 63 has a double structure and comprises an outer side wall ridge 67 projecting downward from the left side edge of the upper wall 61 integrally therewith and extending over the entire height of the tube 60, an inner side wall ridge 68 projecting downward from the upper wall 61 integrally therewith and positioned inside the ridge 67, and an inner side wall ridge 69 projecting upward from the left side edge of the lower wall 62 integrally therewith. The outer side wall ridge 67 is brazed to the two inner side wall ridges 68, 69 and to the lower wail 62, with a lower end portion of the ridge 67 in engagement with a lower surface left side edge of the lower wall 62. The two inner side wall ridges 68, 69 are butted against and brazed to each other. The right side wall 64 is integral with the upper and lower walls 61, 62. The inner side wall ridge 69 of the lower wall 62 is provided on the top end face thereof with a projection 69*a* extending over the entire length thereof integrally therewith. The inner side wall ridge 68 of the upper wall is provided in the lower end face thereof with a groove 68*a* extending over the entire length thereof for the projection 69*a* to be forced in by a press fit.

Each reinforcing wall 65 comprises a reinforcing wall ridge 70 projecting downward from the upper wall 61 integrally therewith, and a reinforcing wall ridge 71 projecting upward from the lower wall 62 integrally therewith, and is formed by butting these ridges 70, 71 against each other and brazing the ridges 70. 71 to each other.

Figure 13:
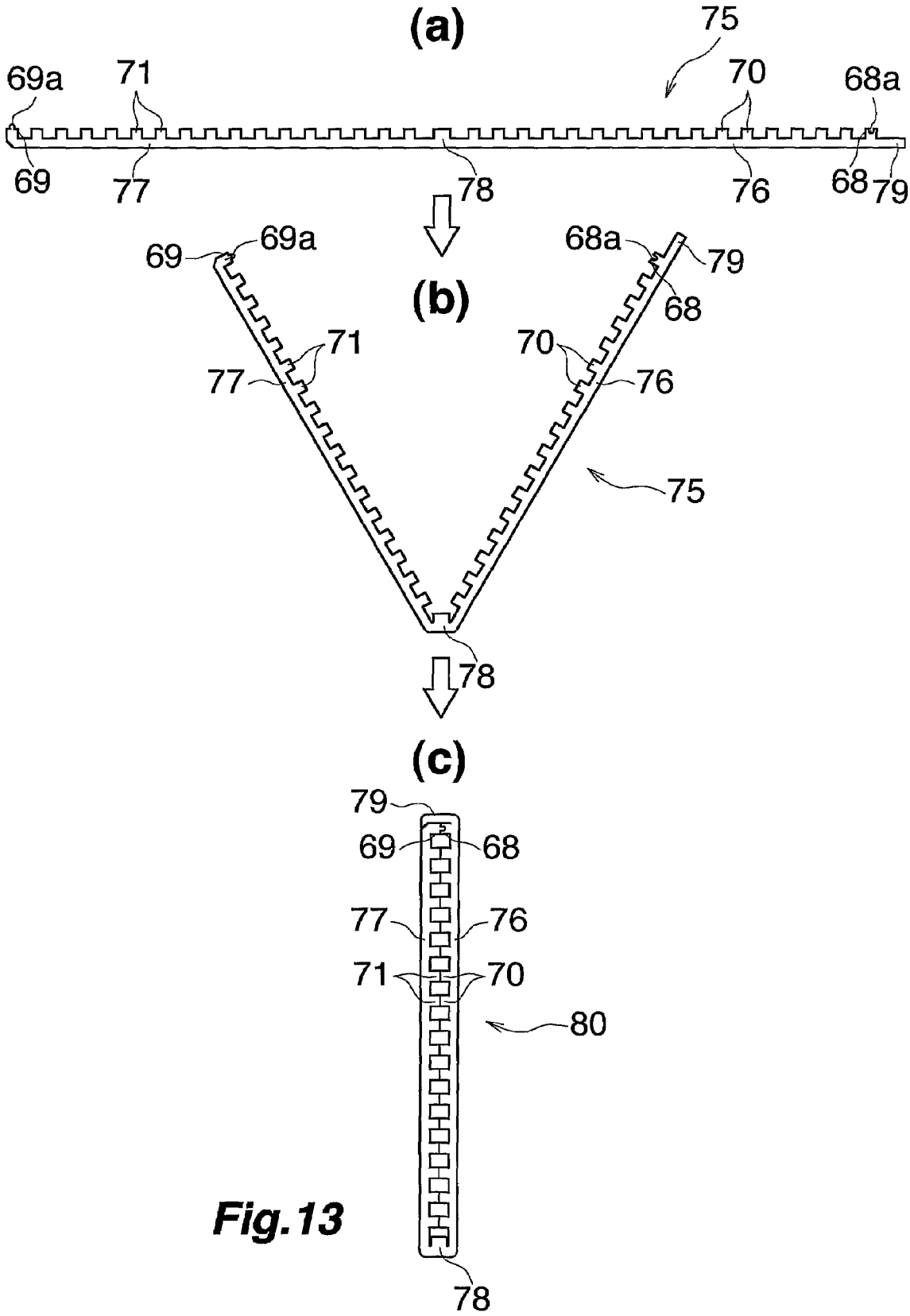
FIG. 13 is a diagram showing a process for fabricating the heat exchange tube of FIG. 11.

The heat exchange tube 60 is fabricated from a tube making metal plate 75 as shown in FIG. 13 (*a*). The metal plate 75 is made of an aluminum brazing sheet having a brazing material layer over opposite surfaces thereof, and comprises a flat upper wall forming portion 76 (flat wall forming portion), a flat lower wall forming portion 77 (flat wall forming portion), a connecting portion 78 interconnecting the upper and lower wall forming portions 76, 77 for making the right side wall 64, inner side wall ridges 68, 69 integrally projecting upward respectively from the upper wall forming portion 76 and the lower wall forming portion 77 each at a side edge thereof opposite to the connecting portion 78 for making the inner portion of the left side wall 63, an outer side wall ridge forming portion 79 formed by extending the upper wall forming portion 76 rightwardly outward at a side edge (right side edge) thereof opposite to the connecting portion 78, and a plurality of reinforcing wall ridges 70, 71 projecting upward respectively from the upper wall forming portion 76 and the lower wall forming portion 77 integrally therewith and arranged at a predetermined spacing in the left-right direction. The reinforcing wall ridges 70 on the upper wall forming portion 76 and the reinforcing wall ridges 71 on the lower wall forming portion 77 are symmetrical about a widthwise center line of the connecting portion 78. A projection 69*a* is formed on the top end of the inner side wall ridge 69 on the lower wall forming portion 77, and a groove 68*a* is formed in the top end of the inner side ridge 68 on the upper wall forming portion 76. The inner side wall ridges 68, 69 and all the reinforcing wall ridges 70*m* 71 are equal in height. The vertical thickness of the connecting portion 78 is larger than the thickness of the upper and lower wall forming portions 76, 77, and the upper end face of the connecting portion 78 is substantially flush with the upper end faces of the inner side wall ridges 68, 69 and the reinforcing wall ridges 70, 71.

Since the side wall ridges 68, 69 and the reinforcing wall ridges 70, 71 are formed integrally on one surface of an aluminum brazing sheet which is clad with a brazing material layer over opposite surfaces thereof, a brazing material layer (not shown) is formed on opposite side faces and the top end faces of the ridges 68, 69 and the ridges 70, 71, and on the upper and lower surfaces of the upper and lower wall forming portions 76, 77. The brazing material layer on the end faces of the ridges 68, 69 and the reinforcing wall ridges 70, 71 has a larger thickness than the brazing material layer on the other portions.

The tube making metal plate 75 is progressively folded at the left and right opposite side edges of the connecting portion 78 by roll forming [see FIG. 13(*b*)], and is finally folded into a hairpin form to butt the inner side wall ridges 68, 69, as well as each corresponding pair of reinforcing wall ridges 70, 71, against each other and to force the projection 69*a* into the groove 68*a* by a press fit.

Subsequently, the outer side wall ridge forming portion 79 is folded onto the outer surface of the inner side wall ridges 68, 69, and the outer end of the portion 79 is deformed into engagement with the lower wall forming portion 77 to obtain a folded body 80 [see FIG. 13(*c*)].

The folded body 80 is thereafter heated at a predetermined temperature to braze the opposed ends of the inner side wall ridges 68, 69 to each other and the opposed ends of each corresponding pair of reinforcing wall ridges 70, 71 to each other, and the outer side wall ridge forming portion 79 is brazed to the inner side wall ridges 68, 69 and to the lower wall forming portion 77, whereby a heat exchange tube 60 is fabricated. The tube 60 is made simultaneously with the fabrication of the evaporator 30.

Figure 14:
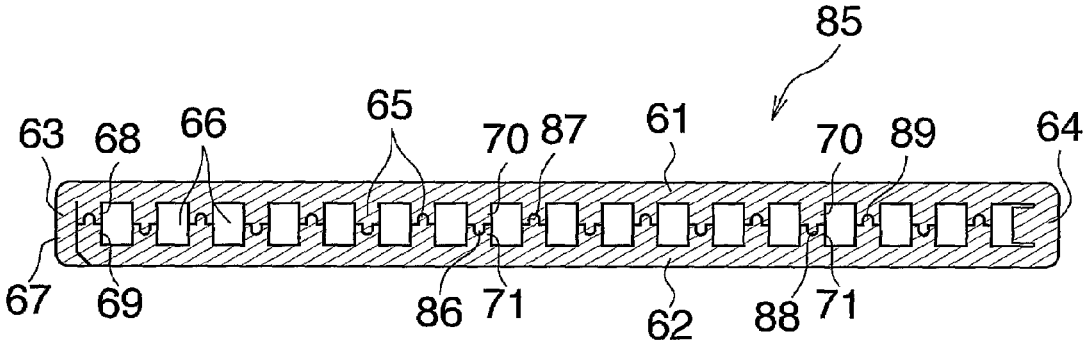
FIG. 14 is a view in cross section showing a second modification of heat exchange tube.

FIG. 14 shows a heat exchange tube 85 wherein the end faces of all reinforcing wall ridges 70 on an upper wall 61 are alternately provided with projections 86 extending over the entire length thereof and grooves 87 extending over the entire length thereof. Further the end faces of all reinforcing wall ridges 71 on the lower wall 62 are alternately provided with grooves 88 for the respective projections 86 of the ridges 70 on the upper wall 61 to be butted thereagainst to fit in, and projections 89 to be fitted into the respective grooves 87 in the reinforcing wall ridges 70 on the upper wall 61, the grooves 88 and the projections 89 extending over the entire length of the tube. With the exception of this feature, the tube 85 has the same construction as the tube 60 shown in FIGS. 11 and 12. The tube 85 is fabricated by the same process as the tube 60 shown in FIGS. 11 and 12.

Figure 15:
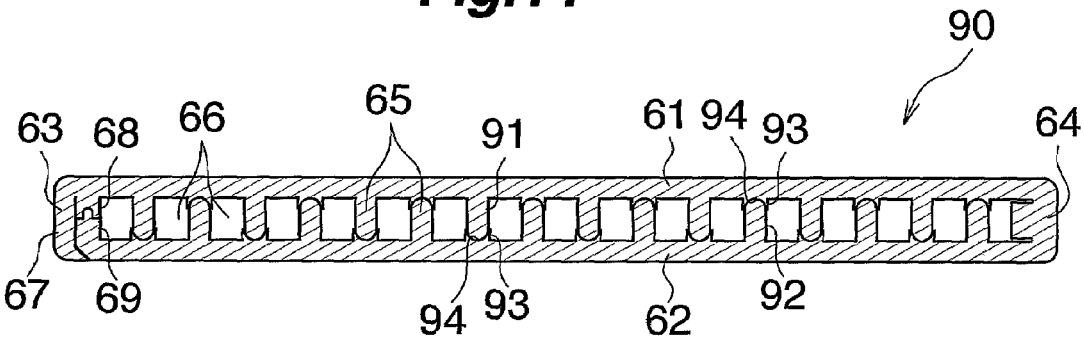
FIG. 15 is a view in cross section showing a third modification of heat exchange tube.
Figure 16:
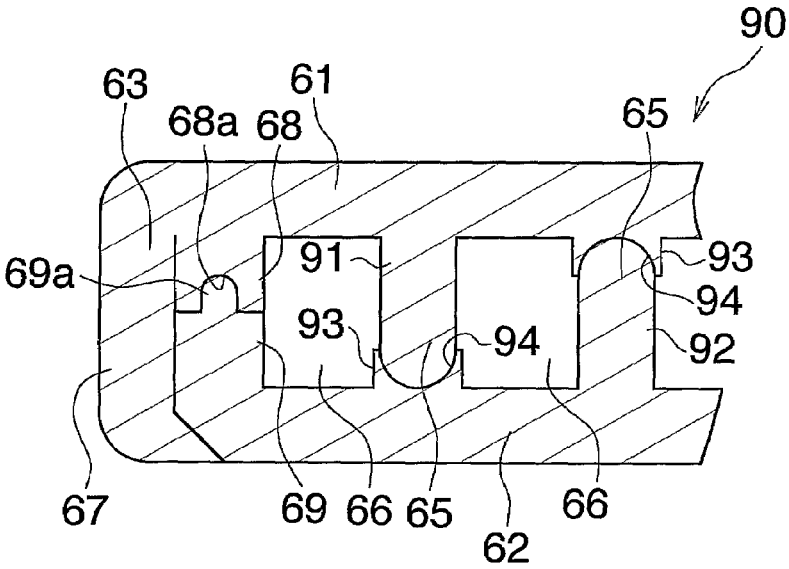
FIG. 16 is an enlarged fragmentary view of FIG. 15.

FIGS. 15 and 16 show a heat exchange tube 90, which has reinforcing walls 65 each comprising a reinforcing wall ridge 91 projecting downward from an upper wall 61 integrally therewith and brazed to a lower wall 62, and reinforcing walls 65 each comprising a reinforcing wall ridge 92 projecting upward from the lower wall 62 and brazed to the upper wall 61, the former reinforcing walls 65 and the latter reinforcing wall being arranged alternately in the left-right direction. The portions of one of the upper walls 61, 62 where the reinforcing wall ridges 92 or 91 of the other wall are brought into contact with the wall are each provided with a protrusion 93, the end face of which is provided with a groove 94 for the end of the ridge 91 or 92 to fit in. The end of the ridge 91 or 92 is fitted in the groove 94 of the protrusion 93 and brazed to the protrusion 93. The left-to-right thickness of the protrusion 93 is slightly larger than the left-to-right thickness of the reinforcing wall ridge 91 or 92. With the exception of the feature described above, the tube 90 has the same construction as the heat exchange tube 60 shown in FIGS. 11 and 12.

Figure 17:
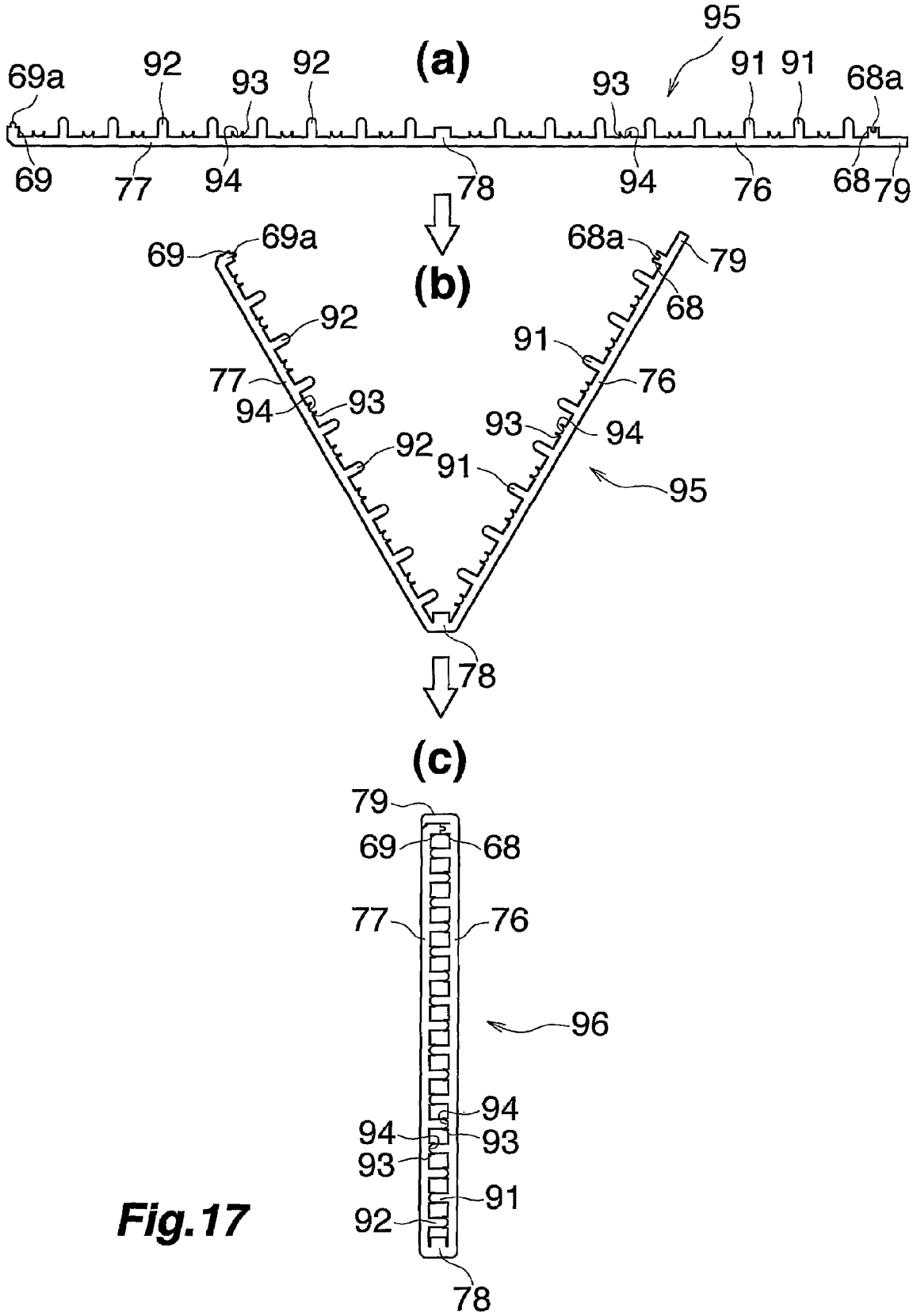
FIG. 17 is a diagram showing a process for fabricating the heat exchange tube of FIG. 15.

The heat exchange tube 90 is fabricated from a tube making metal plate 95 as shown in FIG. 17(*a*). The metal plate 95 is made of an aluminum brazing sheet having a brazing material layer over opposite surfaces thereof, and comprises a plurality of reinforcing wall ridges 91, 92 projecting upward respectively from an upper wall forming portion 78 and a lower wall forming portion 77 integrally therewith and arranged in the left-right direction at a predetermined spacing. The ridges 91 on the upper wall forming portion 76 and the ridges 92 on the lower wall forming portion 77 are so positioned as to be symmetrical about the widthwise center line of a connecting portion 78. The ridges 91, 92 are equal in height, and the height thereof is approximately twice the height of the side wall ridges 68, 69. The areas of the upper wall forming portion 76 and the lower wall forming portions 77 to which the reinforcing wall ridges 92, 91 of the portions 77 and 76 are symmetrical about the center line of the portion 78 are each integrally provided with a protrusion 93 extending over the entire length, and a groove 94 is formed in the end of the protrusion 93 for the end of the ridge 92 or 91 to fit in. With the exception of the above feature, the tube making metal plate 95 has the same construction as the metal plate 75 shown in FIG. 13.

The tube making metal plate 95 is progressively folded at the left and right opposite side edges of the connecting portion 78 by roll forming [see FIG. 17(*b*)], and is finally folded into a hairpin form to butt the inner side wall ridges 68, 69 against each other to force the projection 69*a* into the groove 68*a* by a press fit, and to fit the ends of the reinforcing wall ridges 91 on the upper wall forming portion 76 into the corresponding grooves 94 in the protrusions 93 on the lower wall forming portion 77, and ends of the reinforcing wall ridges 92 on the lower wall forming portion 77 into the corresponding grooves 94 in the protrusions 93 on the upper wall forming portion 76.

Subsequently, the outer side wall ridge forming portion 79 is folded onto the outer surface of the inner side wall ridges 68, 69, and the outer end of the portion 79 is deformed into engagement with the lower wall forming portion 77 to obtain a folded body 96 [see FIG. 17(*c*)].

The folded body 96 is thereafter heated at a predetermined temperature to braze the opposed ends of the inner side wall ridges 68, 69 to each other and the ends of the reinforcing wall ridges 91, 92 to the protrusions 93, and the outer side wall ridge forming portion 79 is brazed to the inner side wall ridges 68, 69 and to the lower wall forming portion 77, whereby a heat exchange tube 90 is fabricated. The tube 90 is made simultaneously with the fabrication of the evaporator 30.

INDUSTRIAL APPLICABILITY

The heat exchanger of the invention is useful as a gas cooler or evaporator, for example, for use in supercritical refrigeration cycles wherein a supercritical refrigerant, such as $CO_2$ (carbon dioxide), is used.

The invention claimed is:

1. A heat exchanger comprising a pair of header tanks arranged as spaced apart from each other, and a plurality of heat exchange tubes arranged in parallel between the pair of header tanks and each having opposite ends joined to the respective header tanks, each of the header tanks comprising a header forming plate, a tube connecting plate and an intermediate plate interposed between the two plates, the header forming plate, the tube connecting plate and intermediate plate being arranged in superposed layers and brazed to one another, the header forming plate being provided with at least one outward bulging portion extending longitudinally thereof and having an opening closed with the intermediate plate, the tube connecting plate being provided at a portion thereof corresponding to the outward bulging portion with a plurality of tube insertion holes arranged longitudinally of the tube connecting plate at a spacing and extending through the thickness thereof, the intermediate plate having communication holes extending through the thickness thereof for causing the respective tube insertion holes of the tube connecting plate to communicate with interior of the outward bulging portion of the header forming plate therethrough, the heat exchange tubes having their opposite ends inserted into the respective tube insertion holes of the tube connecting plates of the header tanks and brazed to the tube connecting plates, at least one of all the outward bulging portions serving as a refrigerant passing outward bulging portion for causing a refrigerant to flow through the interior thereof longitudinally thereof, the intermediate plate communication holes in communication with the refrigerant passing outward bulging portion being held in communication by communication portions formed in the intermediate plate, the communication portions and the communication holes thereby held in communication providing a refrigerant passageway for causing the refrigerant to flow therethrough longitudinally of the refrigerant passing outward bulging portion, the communication portions being adjusted in width to alter the cross sectional area of the refrigerant passageway along the lengthwise direction of the passageway.

2. A heat exchanger according to claim 1 wherein the header forming plate, the tube connecting plate and the intermediate plate are each made from a metal plate by press work.

3. A heat exchanger according to claim 1 wherein the cross sectional area of the refrigerant passageway formed in the intermediate plate of one of the header tanks decreases toward the downstream side with respect to the direction of flow of the refrigerant.

4. A heat exchanger according to claim 1 wherein the cross sectional area of the refrigerant passageway formed in the intermediate plate of one of the header tanks increases toward the downstream side with respect to the direction of flow of the refrigerant.

5. A heat exchanger according to claim 1 wherein the header forming plate of the first of the pair of header tanks has four outward bulging portions arranged widthwise thereof at a spacing and longitudinally thereof at a spacing, and the header forming plate of the second of the pair of header tanks has two outward bulging portions arranged side by side as spaced apart widthwise thereof and opposed to the respective longitudinally adjacent pairs of outward bulging portions of the first header tank, the tube connecting plate of each of the header tanks being provided with a plurality of tube insertion holes at each of widthwise opposite side portions thereof, the intermediate plate of each header tank being provided with a plurality of communication holes at each of widthwise opposite side portions thereof, the two outward bulging portions of one of two pairs of widthwise arranged outward bulging portions of the first header tank each serving as the refrigerant passing outward bulging portion, the first header tank having a refrigerant inlet communicating with interior of one of the refrigerant passing outward bulging portions and a refrigerant outlet communicating with interior of the other refrigerant passing outward bulging portion, the communication holes of the intermediate plate of the first header tank in communication with one of the two outward bulging portions of the other of said two pairs and the communication holes of the intermediate plate in communication with the other outward bulging portion of said other pair being held in communication by refrigerant turn communication portions formed in the intermediate plate to thereby cause the two outward bulging portions of said other pair to communicate with each other, the two outward bulging portions of the second header tank each serving as the refrigerant passing outward bulging portion.

6. A heat exchanger according to claim 5 wherein the refrigerant inlet is provided at one end of the first header tank, and the refrigerant passageway formed in the intermediate plate so as to communicate with the refrigerant passing outward bulging portion in communication with the refrigerant inlet increases in cross sectional area as the passageway extends away from the refrigerant inlet.

7. A heat exchanger according to claim 5 wherein refrigerant passageways formed in the intermediate plate of the second header tank decrease in cross sectional area toward the downstream side with respect to the direction of flow of the refrigerant.

8. A supercritical refrigeration cycle which comprises a compressor, a gas cooler, an evaporator, a pressure reducing device and an intermediate heat exchanger for subjecting refrigerant flowing out from the gas cooler and refrigerant flowing out from the evaporator to heat exchange, and wherein a supercritical refrigerant is used, the gas cooler comprising a heat exchanger according to claim 1.

9. A supercritical refrigeration cycle which comprises a compressor, a gas cooler, an evaporator, a pressure reducing device and an intermediate heat exchanger for subjecting refrigerant flowing out from the gas cooler and refrigerant flowing out from the evaporator to heat exchange, and wherein a supercritical refrigerant is used, the evaporator comprising a heat exchanger according to claim 1.

10. A vehicle having installed therein a supercritical refrigeration cycle according to claim 8 as a vehicle air conditioner.

11. A vehicle having installed therein a supercritical refrigeration cycle according to claim 9 as a vehicle air conditioner.

* * * * *